US005609441A

United States Patent [19]

Khachaturian

[11] Patent Number: 5,609,441

[45] Date of Patent: Mar. 11, 1997

[54] METHOD AND APPARATUS FOR THE OFFSHORE INSTALLATION OF MULTI-TON PREFABRICATED DECK PACKAGES ON PARTIALLY SUBMERGED OFFSHORE JACKET FOUNDATIONS

[76] Inventor: Jon E. Khachaturian, 5827 Rhodes Ave., New Orleans, La. 70131

[21] Appl. No.: 404,421

[22] Filed: Mar. 15, 1995

[51] Int. Cl.[6] ..... E02B 17/00

[52] U.S. Cl. ..... 405/204; 405/209

[58] Field of Search ..... 405/204, 209, 405/203, 196; 114/264, 265

[56] References Cited

U.S. PATENT DOCUMENTS

| | | | |
|---|---|---|---|
| 2,598,088 | 5/1952 | Wilson | 61/46 |
| 3,977,346 | 8/1976 | Natvig et al. | 114/65 R |
| 4,242,011 | 12/1980 | Karsan et al. | 405/204 |
| 4,249,618 | 2/1981 | Lamy | 405/204 X |
| 4,252,468 | 2/1981 | Blight | 405/204 |
| 4,252,469 | 2/1981 | Blight et al. | 405/204 |
| 4,714,382 | 12/1987 | Khachaturian | 405/204 |
| 4,744,697 | 5/1988 | Coppens | 405/204 |
| 5,037,241 | 8/1991 | Vaughn et al. | 405/209 |

*Primary Examiner*—Hoang C. Dang

*Attorney, Agent, or Firm*—Pravel, Hewitt, Kimball & Krieger

[57] ABSTRACT

A method and apparatus for the installation or removal of large multi-ton prefabricated deck packages includes the use of usually two barges defining a base that can support a large multi-ton load. A variable dimensional truss assembly is supported by the barge and forms a load transfer interface between the barge and the deck package. Upper and lower connections form attachments between the truss members and the deck package at upper and lower elevational positions on the deck package. The variable dimension truss includes at least one member of variable length, in the preferred embodiment being a winch powered cable that can be extended and retracted by winding and unwinding the winch.

18 Claims, 8 Drawing Sheets

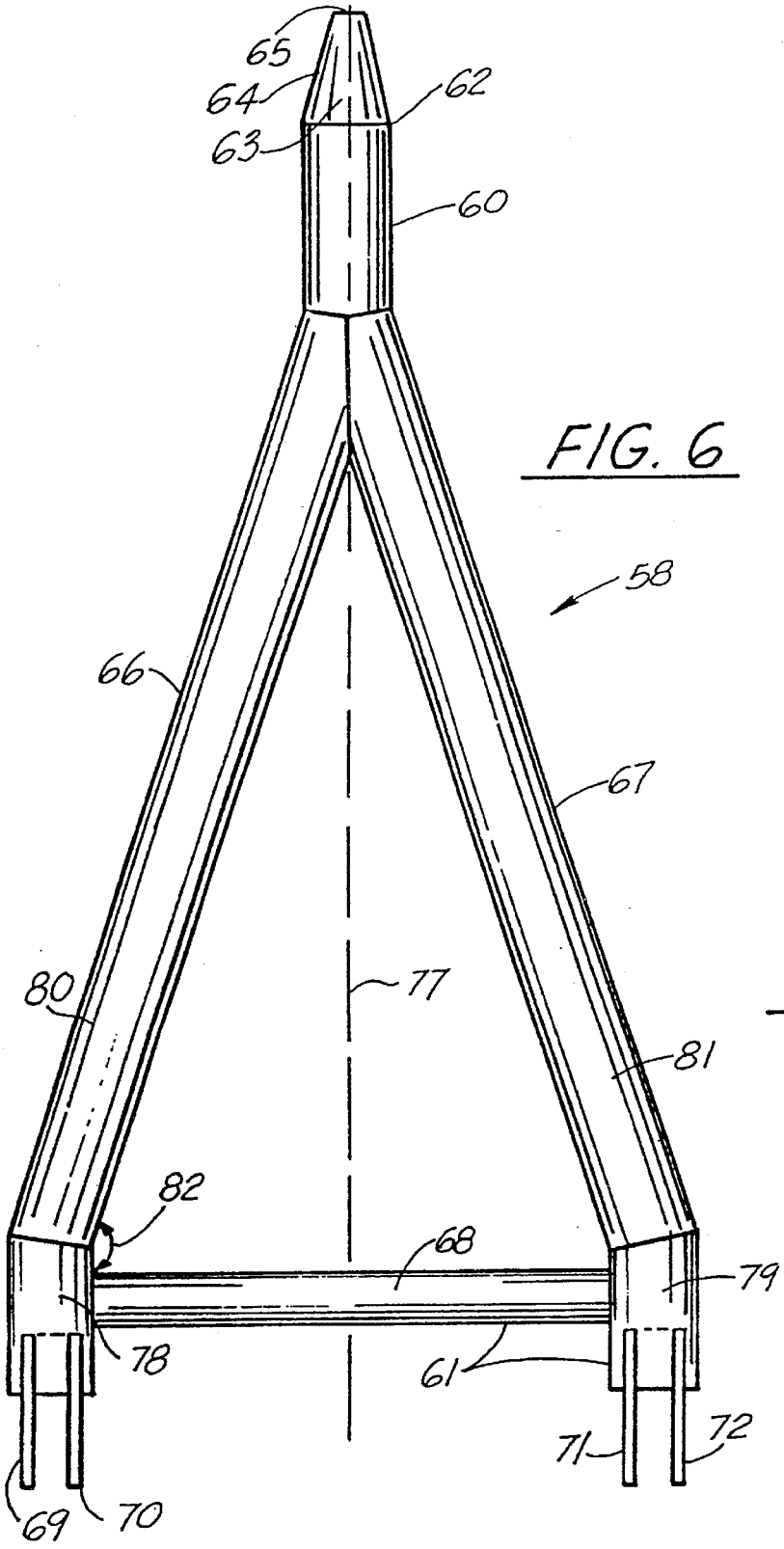
FIG. 6
FIG. 7
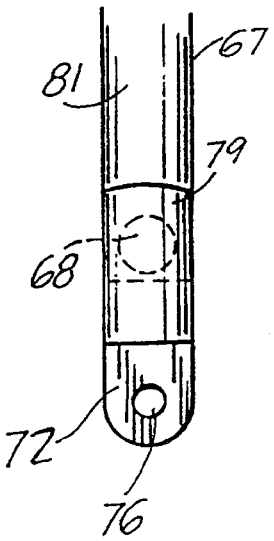

METHOD AND APPARATUS FOR THE OFFSHORE INSTALLATION OF MULTI-TON PREFABRICATED DECK PACKAGES ON PARTIALLY SUBMERGED OFFSHORE JACKET FOUNDATIONS

BACKGROUND OF THE INVENTION

1. Field of the Invention

The present invention relates to the placement of large multi-ton prefabricated deck packages (e.g. oil and gas platforms, oil rigs) in an offshore environment upon a usually partially submerged jacket that extends between the seabed and the water surface. Even more particularly, the present invention relates to the use of a moving lifting assembly which is preferably barge supported that can place a very large deck package upon an offshore marine jacket foundation without the use of enormous lifting booms such as form a part of derrick barges, offshore cranes, and the like, and wherein a "quick connect" connection is formed between the lifting assembly and the deck package.

2. General Background

In the offshore oil and gas industry, the search for oil and gas is often conducted in a marine environment. Sometimes the search takes place many miles offshore. Oil and gas well drilling takes place in many hundreds of feet of water depth.

The problem of drilling oil wells offshore and then producing these wells has been solved in part by the use of enormous fixed platform structures with foundations that are mostly submerged, but usually extending a number of feet above the water surface. Upon this foundation (or "jacket" as it is called in the art) there is usually placed a very large prefabricated rig or deck platform. The term "deck platform" as used herein should be understood to include any of a large variety of prefabricated structures that are placed on an offshore jacket foundation to form a fixed offshore platform. Thus, a "deck-platform" can include, e.g. a drilling rig, a production platform, a crew quarters, living quarters, or the like.

A supporting jacket is usually a very large multi-chord base formed of multiple sections of structural tubing or pipe that are welded together. Such jackets have been used for a number of years for the purpose of supporting large deck platforms in an offshore environment.

The jacket or foundation is usually prefabricated on land in a fabrication yard, preferably adjacent to a navigable waterway. The completed jacket can be placed upon a large transport barge so that it can be moved to the drill site where it will be placed upon the ocean floor. As an example, an offshore jacket can be several hundred feet in length. The size of the jacket is of course a function of the depth of water in which the rig will be placed. A five hundred (500) foot water depth at the drill site (or production site) will require a jacket which is approximately 500–550 feet tall. The jacket is usually partially submerged, with only a small upper portion of the jacket extending slightly above the water surface. An offshore jacket as described and in its position on the seabed can be seen, for example, in the Blight, et al U.S. Pat. No. 4,252,469 entitled "Method and Apparatus for installing integrated Deck Structure and Rapidly Separating Same from Supporting Barge Means." Specifically, FIGS. 1, 2 and 3 of the Blight, et al patent show an offshore jacket on the seabed.

A small upper portion of the jacket extends above the water surface. This exposed portion of the jacket is the portion upon which the "deck platform" is placed and supported by. This upper portion of the jacket is usually equipped with a number of alignment devices which enhance the proper placement of the deck package on the jacket. Such alignment devices are referred to variously as stabbing eyes, sockets, or the like. The use of such alignment devices, sockets, or stabbing eyes can be seen in the Blight, et al Pat. Nos. 4,252,468 and 4,252,469 as well as in the Kansan U.S. Pat. No. 4,242,011. For purposes of background and reference, the Kansan U.S. Pat. No. 4,242,011 is incorporated herein by reference. The Blight, et al U.S. Pat. Nos. 4,252,469 and 4,252,468 are likewise each incorporated herein by reference.

Deck platforms can be extremely large and have correspondingly heavy weights. For example, it is not uncommon for a deck platform such as a drilling rig crew quarters, production platform or the like to be between five hundred and five thousand (500 and 5,000) tons gross weight. Such enormous load values present significant problems in the placement of deck platforms on offshore jacket structures. First, the placement is done entirely in a marine environment. While the jacket can be laid on its side and/or floated into position, the platform is not a submersible structure, and must be generally supported in an upright condition above the water surface to prevent water damage to the many components that form a part of the drilling or production platform (such as electrical systems, wall constructions, and other portions that will be inhabited by individuals and used as oil and gas well drilling or production equipment).

The art has typically used enormous derrick barges for the purpose of setting or placing deck packages on jackets in an offshore environment. These derrick barges are large, rectangular barge structures with a high capacity lifting boom mounted at one end portion of the deck of the barge. The barge, for example might be three hundred to four hundred (300–400) feet in length, fifty to seventy five (50–75) feet in width, and twenty-five to fifty (25–50) feet deep. These figures are exemplary.

A derrick barge might have a lifting capacity of for example, eight hundred (800) tons. For very large structures such as for example, a fifteen hundred (1500) ton deck package, two derrick barges can be used, each supporting one side portion of the deck platform with a multi-line lift system supported by an enormous structural boom extending high into the air above the package during the lift.

The boom simply works in the same way as in onshore lifting boom, namely the loadline raises and/or lowers the package into its proper position upon the jacket. While the use of such derrick barges has been very successful in the placing of offshore deck packages on jackets through the years, such derrick barges are generally limited in their capacity to packages of two thousand (2,000) tons or less. Further, derrick barges of such an enormous capacity are extremely expensive to manufacture and operate. Many thousand of dollars per hour as a cost of using such a device is not uncommon.

However, when very large loads of, for example 3,000–4,000 tons are involved, the limitation of the derrick barge usually prohibits such a placement on an offshore jacket. In U.S. Pat. No. 4,714,38 issued to Jon Khachaturian there is disclosed a method and apparatus for the offshore installation of multi-ton prefabricated deck packages on partially submerged jacket foundations. The Khachaturian patent uses a variable dimensional truss assembly that is supported by the barge and forms a load transfer interface between the barge and the deck package. Upper and lower connections form attachments between the truss members and the deck package at upper and lower elevational positions on the deck package. The variable dimension truss includes at least one member of variable length, in the preferred embodiment being a winch powered cable that can be extended and retracted by winding and unwinding the winch. Alternate embodiments include the use of a hydraulic cylinder as an example.

An earlier patent, U.S. Pat. No. 2,598,088 issued to H. A. Wilson entitled "Offshore Platform Structure and Method of Erecting Same" discusses the placement of drilling structure with a barge wherein the legs of the drilling structure are placed while the drilling structure is supported by two barges. The Wilson device does note use truss-like lifting assemblies having variable length portions which are placed generally on opposite sides of the deck package. Rather, Wilson relates to a platform which is floated in place and the support legs are then placed under the floating platform. Thus, in the Wilson reference, an in-place underlying supporting jacket is not contemplated.

The Natvig, et al U.S. Pat. No. 3,977,346 discusses a method of placing a deck structure upon a building site such as a pier. The method includes the pre-assembly of a deck structure upon a base structure on land so that the deck structure extends outwardly over a body of water. Floating barges are provided for supporting the deck structure outwardly of the building site. The deck structure is then transferred to the supportive base structure by means of barges. The Natvig reference uses two barges which are placed on opposite sides of a platform with pedestal type fixed supports forming a load transfer member between the barges and the platform. However, the fixed pedestal of Natvig are unlike the truss-like lifting arrangement of applicant which include movable portions at least one of which can be of a variable length.

SUMMARY OF THE INVENTION

The present invention provides an improved method and apparatus for the placement of a multi-ton deck package on an offshore jacket. Also the present invention provides an improved method and apparatus for the removal of a multi-ton deck package from an offshore jacket. The present invention discloses an improvement to the variable dimension truss assembly disclosed in U.S. Pat. No. 4,714,382 incorporated herein by reference. The apparatus includes one or more barges defining a base that supports the large multi-ton load of the deck package.

In the preferred embodiment, a horizontally extending truss is mounted on each side of the deck package to be lifted during operation.

In the preferred embodiment, two barges are used respectively, each having a preferably variable dimension lift truss on its upper deck surface. The truss preferably includes a member of variable length so that the cross-sectional dimensions of the truss can be varied.

The truss forms thus a load transfer between each barge and the deck package to be lifted and placed. Upper and lower connections are formed between the lifting truss and the deck package at respective upper and lower elevational positions.

Power is provided, preferably in the form of a winch mounted on the barge for changing the length of the variable length member of the truss so that elevational position of the deck package with respect to t he barge can be varied such as during a lowering of the deck package to the jacket foundation.

In the method of the present invention, the multi-ton deck package is first transported on a transport barge to the site where it will eventually assist in the drilling oil and/or production of a well.

In the preferred embodiment, a lifting assembly is attached to the deck package on generally opposite sides of the deck package and at upper and lower positions.

One element of the truss-like lifting assembly preferably includes a moveable portion which has a variable length. In the preferred embodiment, the movable portion is a winch powered cable which can be extended or retracted between the lift barge and the deck package being lifted.

In the preferred embodiment, two lift barges support respectively a pair of truss-like lifting assemblies which in combination with the deck package form an overall truss arrangement. That is, the deck package itself forms a portion of the truss during the lift, and may carry both compression and tension loads.

The truss-like lifting assemblies thus support the deck package and elevate it above the surface of the transport barge so that the transport barge can be removed as a support for a deck package. This allows the deck package to be placed vertically above the jacket and aligned with the jacket so that the deck package can be placed upon the jacket by lowering.

With the present invention, this allows a dimensional change in the cross-sectional configuration of the truss with respect to a vertical cross section of the truss and provides a means of raising and lowering the deck package.

As an improvement, the present invention provides a quick release arrangement that allows the lifting barges and the lifting boom attached thereto to very quickly attach to or disengage from the deck package being lifted.

The present invention allows a very quick connection to be formed between the multi-ton prefabricated deck package and the variable dimension truss assembly supported upon the barges.

The present invention allows a quick disconnect of the prefabricated multi-ton deck package and the lifting boom portion of the variable dimension truss as soon as the deck package has been properly placed upon the jacket.

An improvement in the method of the present invention involves the use of quick connect fittings that attach the diagonally extending lifting boom portion of the present invention to an upper connection with the deck package being lifted.

The present invention provides an improved boom arrangement that includes a three dimensional lifting boom having a generally "A-frame" shape.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein:

FIG. 6 is a fragmentary view of the preferred embodiment of the apparatus of the present invention illustrating the lifting boom portion thereof;

FIG. 7 is a fragmentary view illustrating a portion of the lifting boom of FIG. 6;

DETAILED DESCRIPTION OF THE PREFERRED EMBODIMENT

Figure 1:
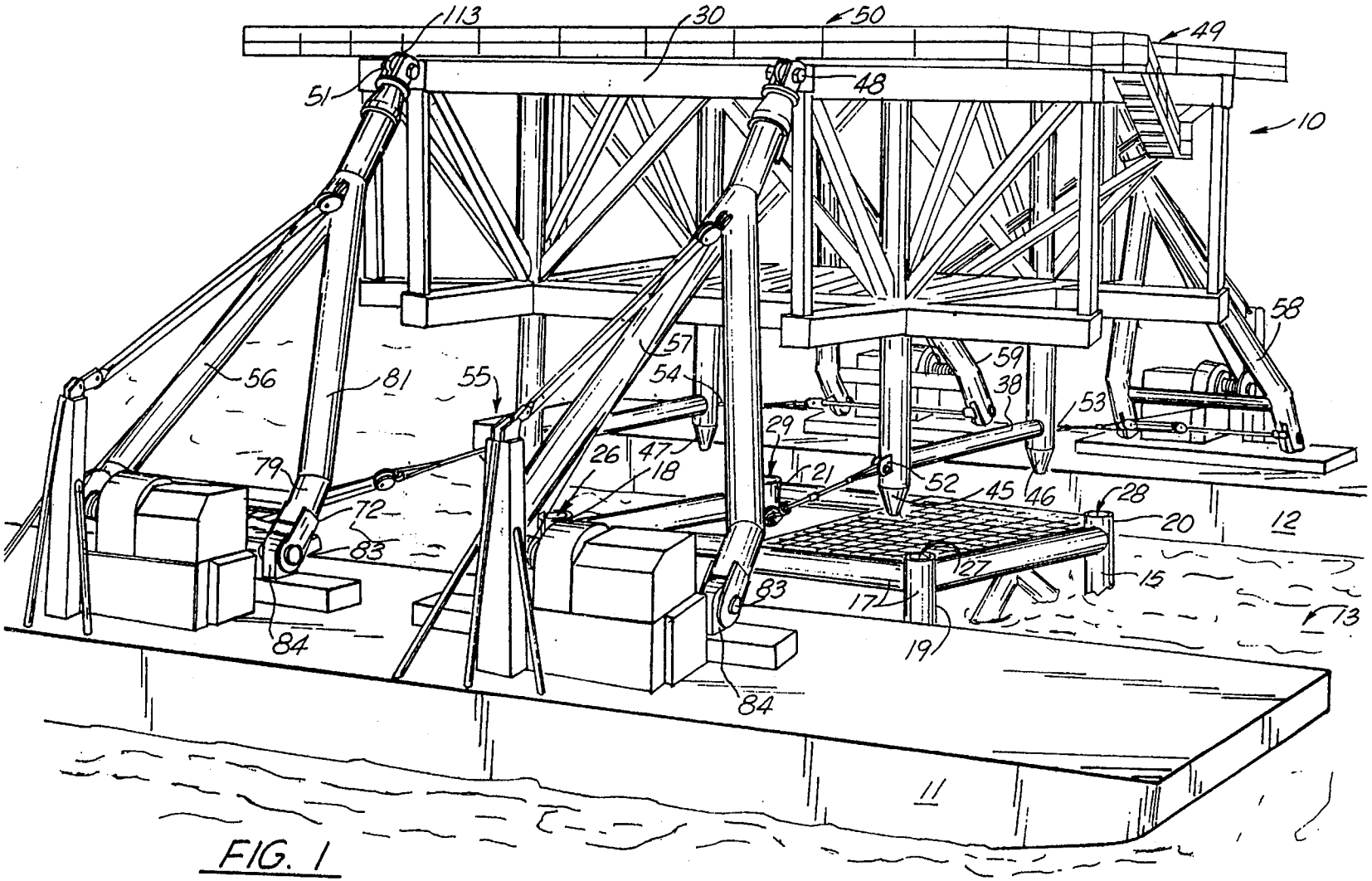
FIG. 1 is a perspective view of the preferred embodiment of the apparatus of the present invention illustrating the deck package being supported in an elevated position above the jacket to which the platform will be attached.
Figure 2:
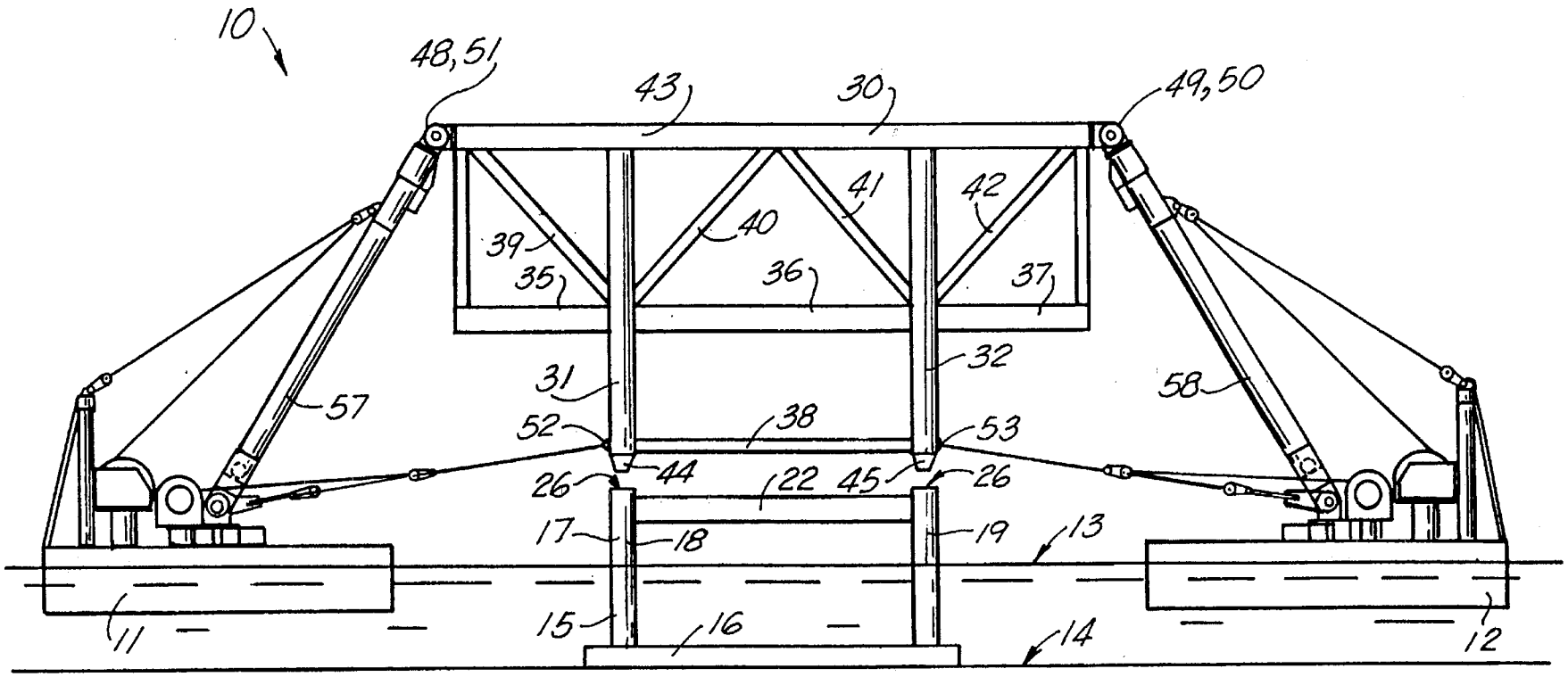
FIG. 2 is an elevational view of the preferred embodiment of the apparatus of the present invention immediately prior to placement of the deck package on jacket.
Figure 3:
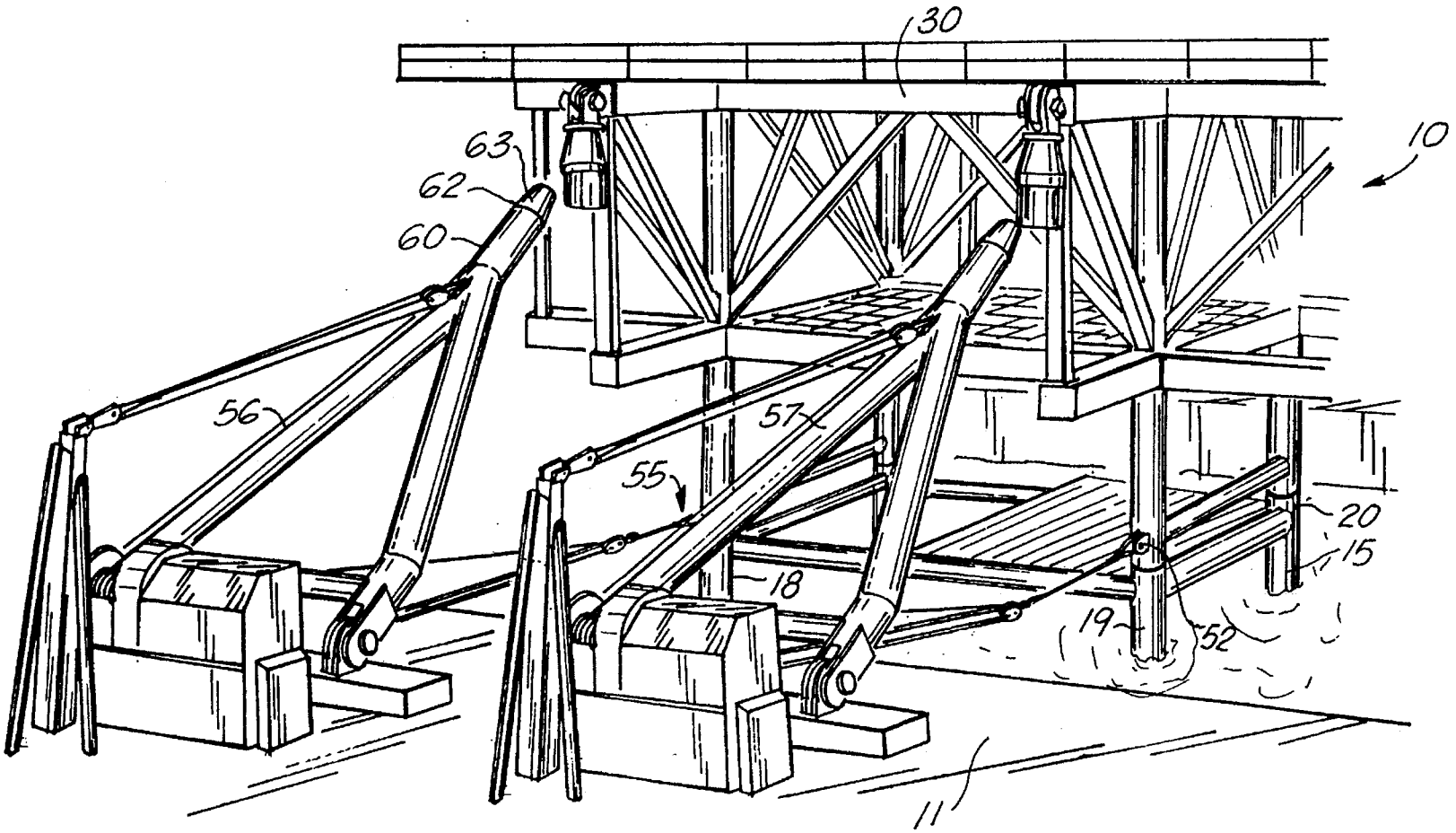
FIG. 3 is a perspective view of the preferred embodiment of the apparatus of the present invention illustrating the deck package in an assembled, installed position upon the jacket and showing a disengaged position of the lifting booms and deck package.

FIGS. 1–3 show generally the preferred embodiment of the apparatus of the present invention designated generally by the numeral 10. Lifting apparatus 10 uses a pair of floating barges 11, 12 to lift a deck package or platform 30. In FIGS. 1–4, each of the barges 11, 12 is preferably a floating type marine barge that floats upon the water surface 13. Barges 11,12 can be standard size marine barges measuring seventy two (72) feet wide and two hundred fifty (250) feet long or fifty four (54) feet wide and one hundred eighty (180) feet long.

For purposes of reference, FIG. 2 shows water surface 13, the seabed 15, and a jacket 15 that is placed on the seabed 14 and which extends above the water surface 13. Jackets 15 are known in the art. The construction of jacket 15 is conventional and known. Jacket 15 typically includes a base 16 that is in some fashion mounted to the seabed 14. The jacket 15 also has an exposed portion 17 that extends above the water surface 13. Jacket 15 can include a plurality of columns 18–21 extending above the water surface 13. Jacket 15 can also include a number of horizonal members 22 that extends between the columns 18–21. Diagonal members (not shown) can also be used to provide reinforcement for jacket 15 as is known in the art.

Figure 4:
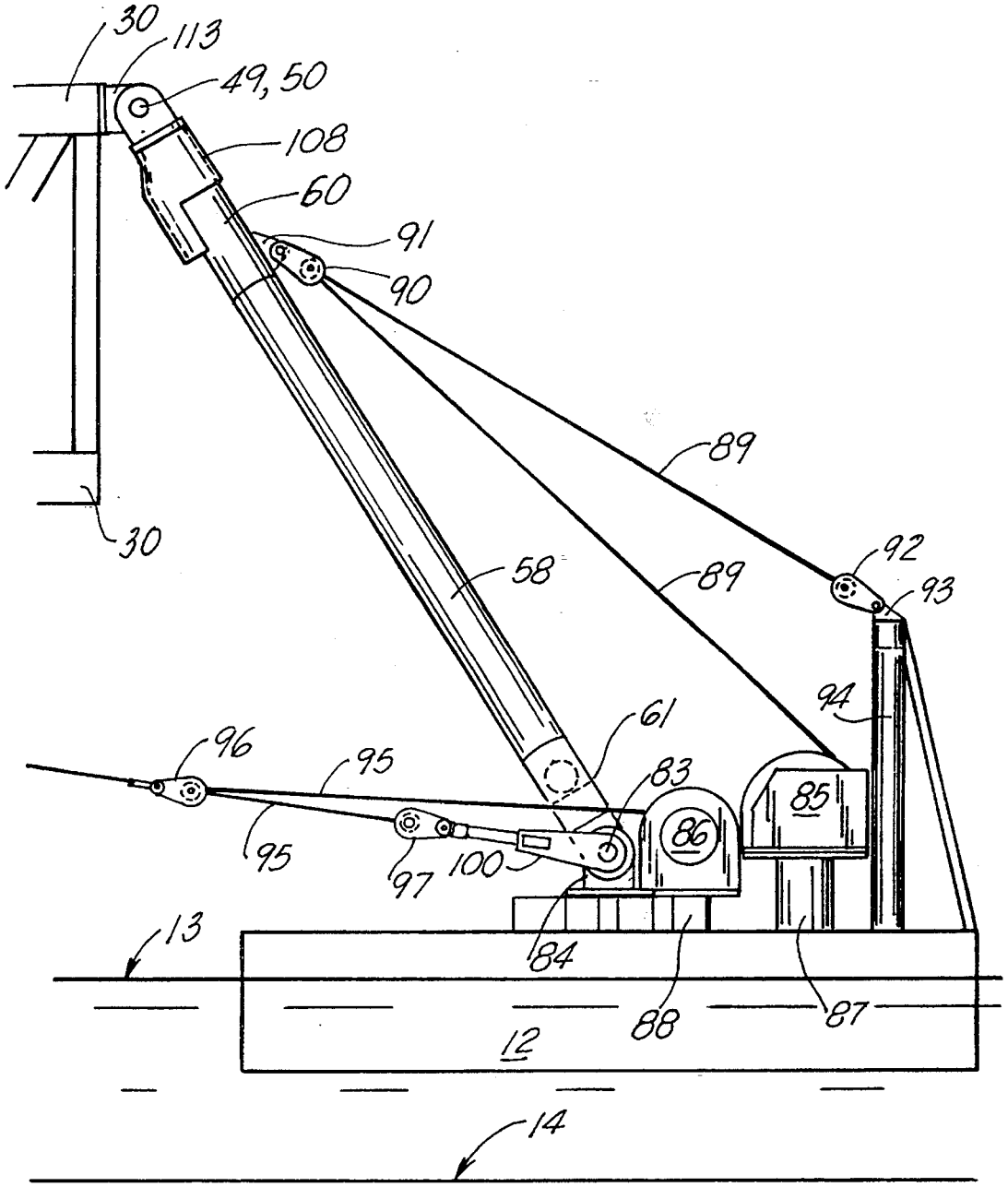
FIG. 4 is a partial elevational view of the preferred embodiment of the apparatus of the present invention illustrating the barge, lifting boom, winches, backstay and cable rigging for one barge.

Each of the columns 18–21 provides a corresponding socket 16–19. The sockets 16–19 receive the lower end portion of the deck package 30 upon assembly. Deck package 30 includes a plurality of columns 31–34, a plurality of horizonal members 35–38, and diagonal members 39–42 as shown in FIG. 4. Typically, such deck packages 30 are prefabricated in a fashion known in the art. Deck packages 30 usually provide an upper expansive structurally reinforced horizonal deck 43 that carries equipment, crew quarters, oil well drilling equipment, oil and gas well production equipment, drilling or production supplies and the like. The lower end portion of deck package 30 includes a plurality of conically shaped projections 44–47 that are sized and shaped to fit the sockets 26–29 of jacket 15.

In order to place deck package 30 on jacket 15, lifting apparatus 10 of the present invention is preferably attached to the deck package 30 after the deck package 30 has been floated to the site of jacket 15 using a transport barge or the like. In order to lift the deck package 30 from its transport barge, upper and lower connections are formed between each barge 11, 12 and the deck package 30 to be lifted as will be described more fully hereinafter. In FIGS. 1–3, a plurality of four upper connections 48–51 are made. In FIGS. 1–4, a plurality of lower connection 52–55 are perfected.

In order to lift the deck package 30, each barge 11–12 is provided with a plurality of lifting booms 56–59. In the preferred embodiment, a pair of lifting booms 56–57 are placed on the barge 11. A pair of lifting booms 58–59 are placed on the barge 12. In FIGS. 4 and 6–7 one of the , the lifting booms 56 is shown in more detail. It should be understood that each of the lifting booms 56–59 is of substantially identical construction, configuration and size as that shown for boom 58 in FIGS. 4 and 6–7. Therefore, only one lift boom 58 is discussed and described in those FIGS. 4 and 6–7.

Lifting boom 58 includes an upper portion 60 that will form a releasable, quick-connect connection with the deck package 30. Lifting boom 58 also includes a lower end portion 61 that is connected with a pinned connection to the barge 11. The upper portion 60 of lifting boom 58 provides a free end 62 having a tip 63. The tip 63 includes a frustroconical outer surface 64 and a flat end portion 65. Each end portion 62 connects to a corresponding socket of a bell connector 108 mounted on the package 30 to be lifted.

Each boom 56–59 is comprised of a pair of boom longitudinal members 66–67 and boom transverse member 68. Each boom 56–59 attaches to its barge 11, 12 using booms padeyes 69–72, each padeye having a corresponding circular opening 73–76 that receives a cylindrical pin 83. A plurality of Correspondingly shaped deck-padeyes 84 are provided on the barge 11 so that a pinned connection can be formed between the padeyes 69–71 of each boom 56–59 and the padeyes 84 of the respective barge 11 or 12 using a cylindrical pin 83 (see FIGS. 1–4).

Reference line 77 in FIGS. 6 and 7 is the central longitudinal axis of upper cylindrical portion 60 of each lifting boom 56–59. Reference line 77 is also perpendicular to the central longitudinal axis of boom transverse member 68. Each of the padeyes 69–72 is preferably a flat padeye member that is parallel to reference line 77. Similarly, each deck padeye 84 is a flat plate member that is parallel to reference line 77. Pin 83 is perpendicular to reference line 77.

Longitudinal members 66–67 each include short and long portions. The boom longitudinal member 66 includes short sections 78 and long section 80. The boom longitudinal member 66 includes short section 79 and long section 81. An obtuse angle 82 is formed between each of the short sections 78, 79 and its respective long section 80, 81. In FIGS. 1–4 and 5, there can be seen a pair of winches 85, 86. Each winch 85, 86 can be a commercially available winch such as the Skaggitt RB90 or Amcom 750. Such winches are very powerful, having a single line pull of about one hundred fifty thousand (150,000) pounds for example. Sheaves are then used to increase the overall horizontal pulling capacity of the system as required from job to job.

Each winch 85, 86 is structurally mounted to its respective barge 11, 12 with a pedestal. Winch 85 is mounted upon pedestal 87. Winch 86 is mounted upon pedestal 88.

In FIG. 4, the winch 85 is wound with an elongated cable 89 that is routed through sheave 90 and sheave 92 as many times as necessary to develop the capacity to raise or lower the respective boom 56–59 for quick connection. A padeye 91 is mounted at the upper end 60 of lift boom 58 as shown in FIG. 4. Sheave 90 mounts to padeye 91 as shown. The sheave 92 is mounted upon padeye 93 at the upper end of backstay 94. The winch 85 as rigged in FIG. 4 can be used to raise and lower the desired lift boom 56–59 as the particular lift boom 56–59 rotates about pin 83. However, during actual lifting of the deck package 30, the cable 89 is not required and is slack until time of disconnection.

Figure 5:
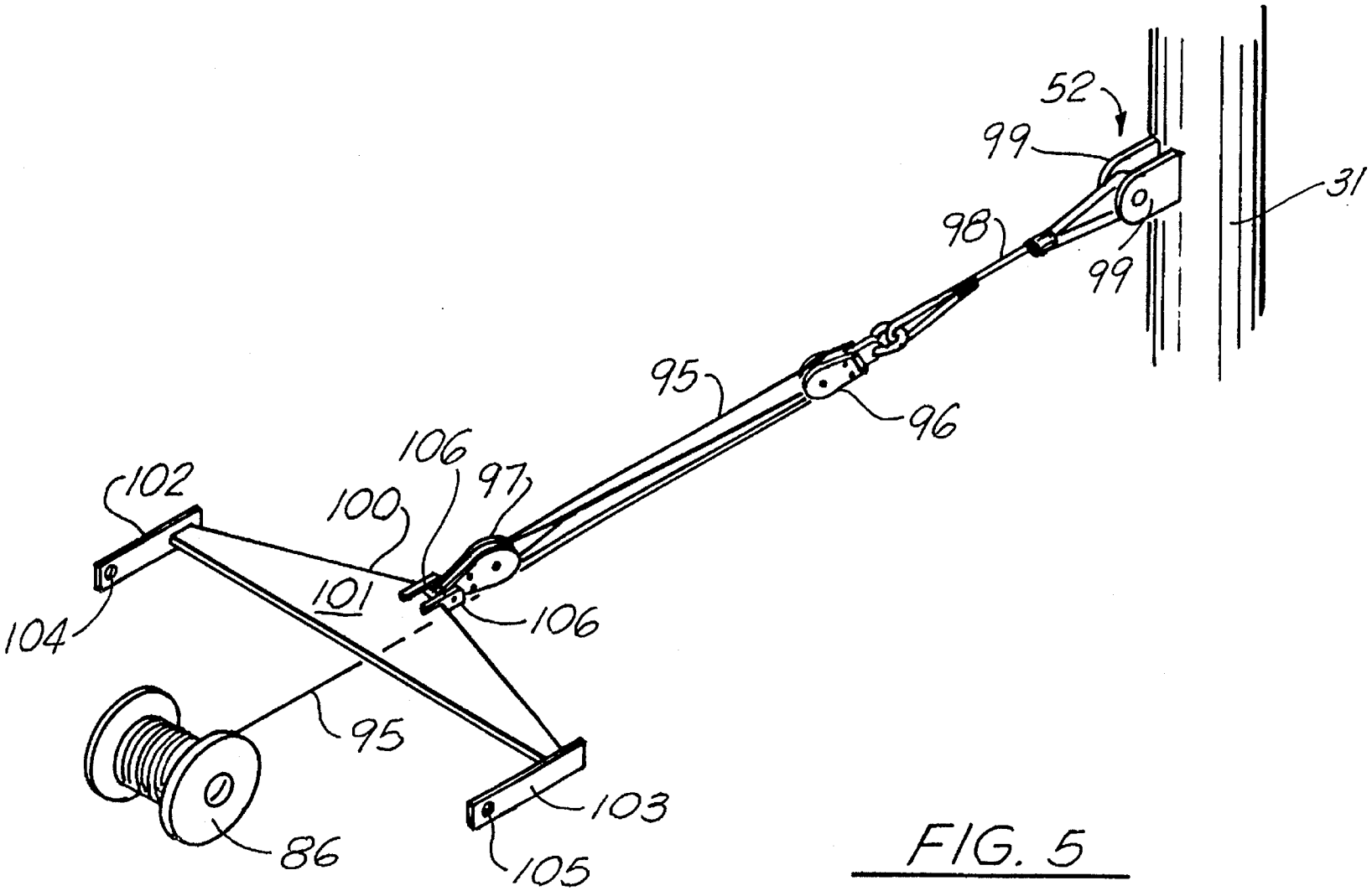
FIG. 5 is a partial perspective view of the preferred embodiment of the apparatus of the present invention illustrating a portion of rigging.

Winch 86 is mounted upon pedestal 88. The winch 86 has an elongated cable 95 wound upon the winch. The cable 95 is rigged to sheave 96 and sheave 97. The sheave 96 connects to the rig package 30 at the above described lower connections 52–55. In FIG. 5, a typical rigging between winch 86 and a vertical column 31 of platform 30 is shown. The winch 86 is wound with the elongated cable 95 that is routed through the sheaves 96 and 97 as many times as necessary to develop the load required to lift deck package 30. Sling 98 can be sized to carry the entire load. The sheave 96 attaches to sling 98. The sling 98 is attached to padeyes 99 mounted on vertical column 31 of platform 30. The sheave 97 is attached to spreader plate 100 at padeye 106, each having an opening 107 for receiving a pin so that the user can form a connection between the sheave 97 and the plate 100 at padeyes.

Figure 8:
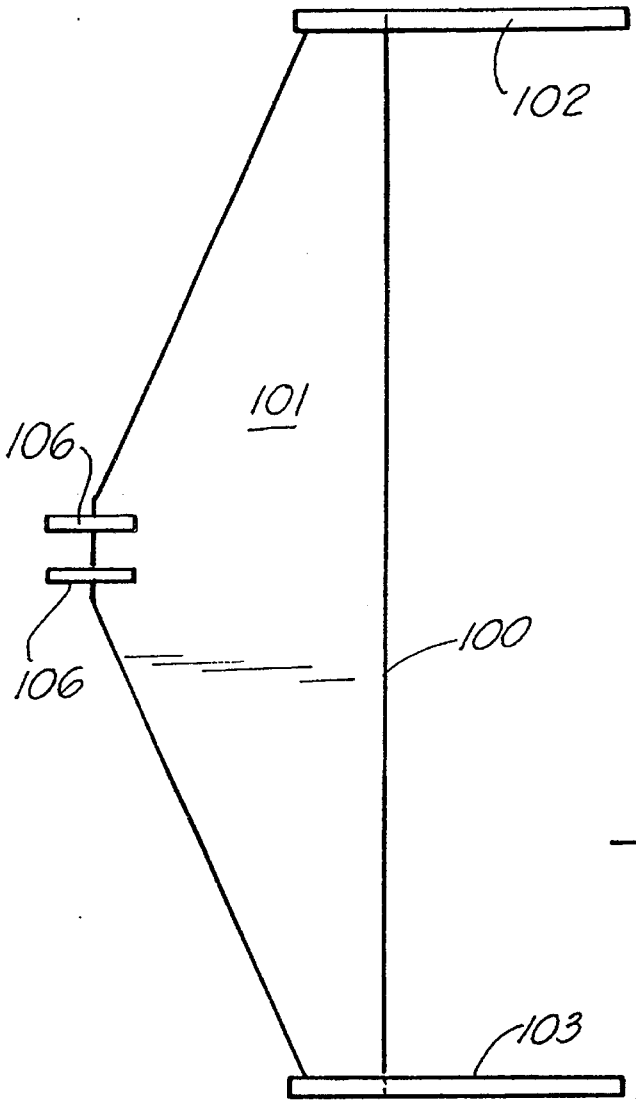
FIG. 8 is a fragmentary top view of the preferred embodiment of the apparatus of the present invention illustrating the spreader plate portion.
Figure 9:
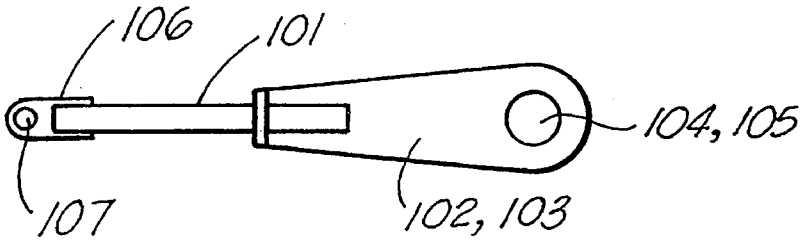
FIG. 9 is a fragmentary side view of the spreader plate of FIG. 8.

In FIGS. 5 and 8–9, spreader plate 100 is shown more particularly. The spreader plate 100 includes a triangular plate section 101 with a pair of transverse plate members 102, 103 mounted to the end portions of the triangular plate 101 as shown in FIGS. 5 and 8. Each of the transverse plates 102, 103 provides an opening for attaching the spreader plate 100 at its openings 104, 105 to the barge padeyes 84. The openings 104, 105 thus provide a reference for alignment. When the openings 104, 105 are used to attach the spreader plate 100 to pin 83 at barge padeyes 84, this arranges the plates 103, 104 perpendicular to the central longitudinal axis of pin 83. Further, the padeyes 106 are spaced an equal distance from each of the transverse plates 102, 103 mainly at the center of triangular plate section 101. This arrangement centers the winch cable 95 and the sling 98 on the center of the winch 86.

During use, the winch 86 can thus be used to pay out or to pull in cable 95 thus determining the distance between each of the barges 11, 12 and the deck package 30 to be lifted. Further, it should be understood by an inspection of FIGS. 1 and 3, that the horizontal member 38 of deck package 30 is at the same elevation as the lower connections 52, 53. In this fashion, the deck package 30 itself carries the tensile load that is transmitted to the deck package 30 by the cable 95 and sling 98.

Figure 10:
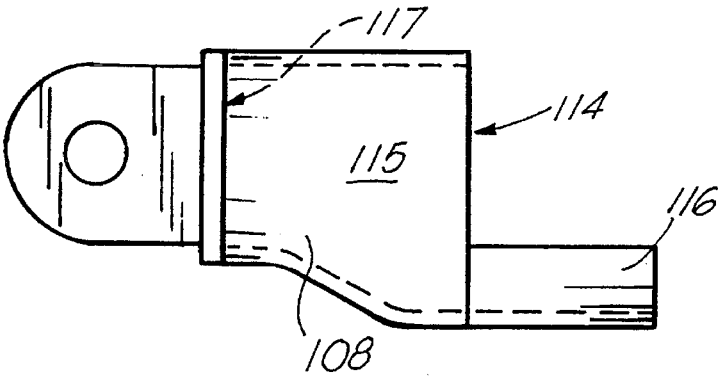
FIG. 10 is a fragmentary side view illustrating the bell connector portion thereof.
Figure 12:
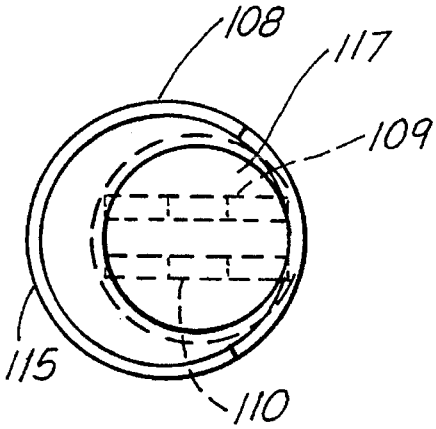
FIG. 12 is an end view of the bell connector of FIG. 10.
Figure 11:
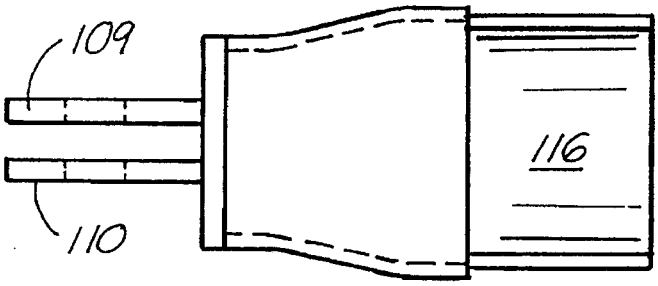
FIG. 11 is a top view of the bell connector of FIG. 10.

The present invention provides a quick connect, quick disconnect method and apparatus for forming a connection between each lifting boom 56–59 and the deck package 30. In FIGS. 1–4, there can be seen a bell connector 108 that is pinned to the deck package 30 at each of the upper connections 48–51. The bell 108 is shown more particularly in FIGS. 10–12. Each bell 108 provides a pair of padeyes 109, 110 each padeye 109, 110 provides an opening 111, 112 respectively. This opening allows a pinned connection to be formed between each bell connector 108 and a platform padeye 113. The padeye 108 provides a socket 114 that receives the cone end portion of each lifting boom 56–59. A surrounding side wall 115 is sized and shaped to conform and fit the conical end of each boom 56–59. A projecting curved wall portion 116 extends away from the portion 115 as shown in FIGS. 10 and 11. The curved wall portion 116 extends about 120° rather than a full 360° about wall 115. This allows the end portion 62 of each boom 56–59 to engage the member 116 as a point of reference before entering the socket 114. An end plate 117 extends transversely. The padeyes 113 are mounted to the end plate 117. The side wall 115 extends from the opposite side of end plate 117. The bell 108 can be of welded, structural steel construction. The socket 114 closely conforms in size and shape to the frustroconical tip 63 of each lifting boom 56–59. The plate end portion 65 of each lifting boom 56–59 bears against flat plate 117. In FIG. 1, each of the lifting booms 56–59 has engaged a bell connector 108.

The winch 86 can be used to lower a deck package 30 into position on a selected jacket 15. The winch 86 can also be used to raise a deck package 30 that is already supported upon a jacket 15. For example, obsolete or abandoned deck platforms 30 can be removed from a jacket 15 using the method and apparatus of the present invention as described above.

The following table lists the parts numbers and parts descriptions as used herein and in the drawings attached hereto.

PARTS LIST

| Part Number | Description |
|---|---|
| 10 | lifting apparatus |
| 11 | barge |
| 12 | barge |
| 13 | water surface |
| 14 | seabed |
| 15 | jacket |
| 16 | base |
| 17 | exposed portion |
| 18 | column |
| 19 | column |
| 20 | column |
| 21 | column |
| 22 | horizontal member |
| 23 | horizontal member |
| 24 | horizontal member |
| 25 | horizontal member |
| 26 | socket |
| 27 | socket |
| 28 | socket |
| 29 | socket |
| 30 | deck package |
| 31 | column |
| 32 | column |
| 33 | column |
| 34 | column |
| 35 | horizontal member |
| 36 | horizontal member |
| 37 | horizontal member |
| 38 | horizontal member |
| 39 | diagonal member |
| 40 | diagonal member |
| 41 | diagonal member |
| 42 | diagonal member |
| 43 | deck |
| 44 | projection |
| 45 | projection |
| 46 | projection |
| 47 | projection |
| 48 | upper connection |
| 49 | upper connection |
| 50 | upper connection |
| 51 | upper connection |
| 52 | lower connection |
| 53 | lower connection |
| 54 | lower connection |
| 55 | lower connection |

-continued

PARTS LIST

| Part Number | Description |
|---|---|
| 56 | lifting boom |
| 57 | lifting boom |
| 58 | lifting boom |
| 59 | lifting boom |
| 60 | upper cylindrical portion |
| 61 | lower end portion |
| 62 | free end |
| 63 | frustroconical tip |
| 64 | frustroconical surface |
| 65 | flat end portion |
| 66 | boom longitudinal member |
| 67 | boom longitudinal member |
| 68 | boom transverse member |
| 69 | padeye |
| 70 | padeye |
| 71 | padeye |
| 72 | padeye |
| 73 | opening |
| 74 | opening |
| 75 | opening |
| 76 | opening |
| 77 | reference line |
| 78 | short section |
| 79 | short section |
| 80 | long section |
| 81 | long section |
| 82 | angle |
| 83 | pin |
| 84 | deck padeye |
| 85 | winch |
| 86 | winch |
| 87 | pedestal |
| 88 | pedestal |
| 89 | cable |
| 90 | sheave |
| 91 | padeye |
| 92 | sheave |
| 93 | padeye |
| 94 | backstay |
| 95 | cable |
| 96 | sheave |
| 97 | sheave |
| 98 | sling |
| 99 | padeye |
| 100 | spreader plate |
| 101 | triangular plate section |
| 102 | transverse plate |
| 103 | transverse plate |
| 104 | opening |
| 105 | opening |
| 106 | padeye |
| 107 | opening |
| 108 | bell |
| 109 | padeye |
| 110 | padeye |
| 111 | opening |
| 112 | opening |
| 113 | padeye |
| 114 | socket |
| 115 | side wall |
| 116 | member |
| 117 | end plate |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A lifting apparatus for placing a multi-ton deck package on an offshore jacket foundation, comprising:

a) a pair of barges, each defining a base that can support a large multi-ton load;

b) truss means supported by the barges about the periphery of the deck package for forming a load transfer between the barges and the deck package to be placed, said truss means including a plurality of diagonally extending lift booms, each lift boom having a lower end attached to the barge and an upper free end;

c) upper and lower connection means for forming attachments of the truss means to the deck package at upper and lower respective elevational positions; and d) said upper and lower connection means including corresponding connecting portions that enable the barges and package to quick disconnect, one of said corresponding quick connecting portions including the upper free end portion of the lifting boom, said other quick connecting portion being positioned at said upper elevational position wherein a projection registers in a socket to form a connection between the lifting boom and the deck package;

e) means for lowering the combination of the truss means and the supported deck package with respect to the jacket foundation during placement of the deck package on the jacket foundation.

2. The apparatus of claim 1 wherein the truss means is a variable dimension truss means that includes a lifting boom and at least one truss member of variable length.

3. The apparatus of claim 1 wherein the barge includes two barges with horizontal surfaces spaced generally on opposite sides of the deck package being lifted during placement of the deck package on the jacket foundation.

4. The apparatus of claim 1 wherein the truss means includes two opposing truss members that are each pinned to a different barge and which are angularly disposed with respect to each other during use.

5. The apparatus of claim 1 wherein the lowering means includes a winch operated cable.

6. The apparatus of claim 1 wherein each lifting boom is an "A" frame shaped boom.

7. The apparatus of claim 2 wherein the variable length truss member includes multiple winch and cable assemblies spaced along the upper deck surface of each barge.

8. A lifting apparatus for placing a multi-ton deck package on an offshore jacket foundation, comprising:

a) a pair of barges, each defining a base that can support a large multi-ton load;

b) truss means supported by the barges about the periphery of the deck package for forming a load transfer between the barges and the deck package to be placed, said truss means including a plurality of diagonally extending lift booms, each lift boom having a lower end attached to the barge and an upper free end;

c) upper and lower connection means for forming attachments of the truss means to the deck package at upper and lower respective elevational positions; and d) said upper and lower connection means including corresponding connecting portions that enable the barges and package to quick disconnect, one of said corresponding quick connecting portions including the upper free end portion of the lifting boom, said other quick connecting portion being positioned at said upper elevational position;

e) means for lowering the combination of the truss means and the supported deck package with respect to the jacket foundation during placement of the deck package on the jacket foundation; and f) wherein the upper connection means is a quick connect formed between a socket at the upper position on the deck package and the projection on the free end portion of the lifting boom.

9. The apparatus of claim 8 wherein the truss means includes a winch operating a winch cable.

10. A method for the offshore installation of a multi-ton prefabricated deck package on a jacket foundation, comprising the steps of:

a) transporting the prefabricated deck package to the site of the jacket foundation on a transport barge;

b) attaching a triangular truss-like lifting assembly to the deck package at multiple elevational positions on the deck package including positions that are at least on generally opposite sides of the deck package, and at upper and lower positions on the deck package respectively and at vertices of the triangular truss-like lifting assembly, the triangular truss-like lifting assembly including at least three chords, including a horizontal chord normally in tension during the lifting process which has a variable length and a diagonally extending chord normally in compression during the lifting process;

c) using corresponding socket and projection quick connect fittings to attach the diagonally extending chord to the deck package wherein a projection registers in a socket to form the connection between the diagonally extending chord and deck package;

d) structurally supporting the triangular truss-like lifting assembly with one or more lift barges;

e) removing the transport barge as a support for the deck package so that the deck is supported by the triangular truss-like lifting assembly and lift barges, with the deck package forming a load carrying portion of the triangular truss-like lifting assembly;

f) aligning the deck package with the jacket so that the deck package can be placed on the jacket; and g) lowering the deck package upon the jacket by changing the length of the horizontal chord of each triangular truss-like lifting assembly.

11. The method of claim 10, wherein the deck package is placed on the jacket foundation by lengthening the variable length lifting assembly.

12. The method of claim 10, wherein the truss-like lifting assembly lowers the deck package during placement of the deck package on the jacket foundation.

13. The method of claim 10, wherein in step "f", the variable length of the lifting assembly includes a winch that is wound with a lift cable which winds/unwinds to change the length of the cable.

14. The method of claim 10, wherein in step "d" the lift barges are floating barges.

15. The method of claim 10, wherein in step "b" one portion of the lifting assembly includes a plurality of compression carrying diagonally extending lift booms, each with opposing end portions that are pinned at one end to the barge.

16. The method of claim 15, wherein each lift barge has a winch structurally mounted thereon and the lower connection formed with the package deck includes a flexible cable extending between the winch and the deck package.

17. The method of claim 16, wherein the truss-like lifting assembly includes a plurality of non-extensible diagonally extending lift booms, each connecting to the lift barge and to the upper attachment position of the deck package.

18. A method for the offshore installation of a multi-ton prefabricated deck package on a jacket foundation, comprising the steps of:

a) transporting the prefabricated deck package to the site of the jacket foundation;

b) attaching a triangular truss-like lifting assembly to the deck package at multiple elevational positions on the deck package, including upper and lower positions that are at least on generally opposite sides of the deck package, said upper and lower positions being on the deck package respectively and at vertices of the triangular truss-like lifting assembly, the triangular truss-like lifting assembly including at least three chords, including a horizontal chord normally in tension during the lifting process which has a variable length and a diagonally extending three dimensional lifting boom normally in compression during the lifting process;

c) using quick connect fittings to attach the diagonally extending lifting boom to the deck package wherein one of the quick connect fittings is a projection on the lifting boom and a receptacle on the deck package that is shaped to receive the projection, forming a load transfer connection therewith that can carry load between the boom and the deck package as occurs during a lifting of the deck package by the booms;

d) structurally supporting the triangular truss-like lifting assembly with one or more lift barges, the lifting boom being pivotally attached to a barge;

e) wherein the deck package is supported by the triangular truss-like lifting assembly and lift barges, with the deck package forming a load carrying portion of the triangular truss-like lifting assembly;

f) aligning the deck package with the jacket so that the deck package can be placed on the jacket; and g) lowering the deck package upon the jacket by changing the length of the horizontal chord of each triangular truss-like lifting assembly.

* * * * *